United States Patent [19]

Kenjorski

[11] 4,381,809

[45] May 3, 1983

[54] SPLITTING AX

[76] Inventor: Arthur A. Kenjorski, 18505 US 23 N., Alpena, Mich. 49707

[21] Appl. No.: 326,601

[22] Filed: Dec. 2, 1981

[51] Int. Cl.[3] ..... B26B 23/00

[52] U.S. Cl. ..... 145/2 R; 144/193 C; 144/193 D

[58] Field of Search ..... 145/2 R; 144/193 C, 144/193 D, 193 E, 193 F

[56] References Cited

U.S. PATENT DOCUMENTS

| | | | |
|---|---|---|---|
| 2,690,323 | 9/1954 | Evenson | 144/193 C |
| 2,814,475 | 11/1957 | Jay | 145/2 R |
| 3,038,510 | 6/1962 | Vorkoeper et al. | 144/193 D |
| 3,749,365 | 7/1973 | Van Gompel | 144/193 C |
| 3,982,572 | 9/1976 | Kortendick | 145/2 R |
| 4,044,808 | 8/1977 | Kolonia | 145/2 R |
| 4,130,270 | 12/1978 | Andersson | 144/193 C |

FOREIGN PATENT DOCUMENTS

| | | | |
|---|---|---|---|
| 1045360 | 6/1953 | France | 144/193 D |
| 63443 | 4/1941 | Norway | 144/193 D |
| 273318 | 5/1951 | Switzerland | 144/193 C |
| 603135 | 6/1948 | United Kingdom | 144/193 D |
| 1583243 | 1/1981 | United Kingdom | 144/193 D |

*Primary Examiner*—Roscoe V. Parker
*Assistant Examiner*—J. T. Zatarga
*Attorney, Agent, or Firm*—Harpman & Harpman

[57] ABSTRACT

A splitting ax for splitting logs comprises a two piece head portion with a cutting edge that pivots open on impact with the wood. The head portion encloses a movable wedge which forces the head portions apart as the cutting edge engages the wood. The head portion automatically closes as the ax is removed from the wood.

6 Claims, 3 Drawing Figures

SPLITTING AX

BACKGROUND OF THE INVENTION (1) Field of the Invention

This invention relates to wood splitting devices which are used to split logs so they may be burned more easily.

(2) Description of the Prior Art

Prior art devices of this type have utilized a variety of different configurations. See for example U.S. Pat. Nos. 2,814,475, 3,982,572, and 4,044,808.

In U.S. Pat. No. 2,814,475, a rock breaking device is disclosed wherein a plug is driven between a pair of tapered members spreading them apart.

U.S. Pat. No. 3,982,572 shows a log splitter having a pair of vertical supports guiding a horizontal bar with a wedge secured onto it which can be driven into the log splitting the same.

In U.S. Pat. No. 4,044,808, a splitting assembly is disclosed wherein an ax is equipped with lever members that pivot outwardly as the ax passes through the wood splitting the same apart.

In applicant's device, the entire head portion of the ax moves open on impact expanding the wood in contact therewith and increasing the splitting action imparted to the wood.

SUMMARY OF THE INVENTION

A log splitting ax comprises a two piece head portion with a cutting edge that is forced open on impact with a log by a movable heavy wedge enclosed within. The head portion closes by spring action as the ax is removed from the log increasing the efficiency of the ax and ease of removal of the ax from the wood.

DESCRIPTION OF THE PREFERRED EMBODIMENT

Figure 1:
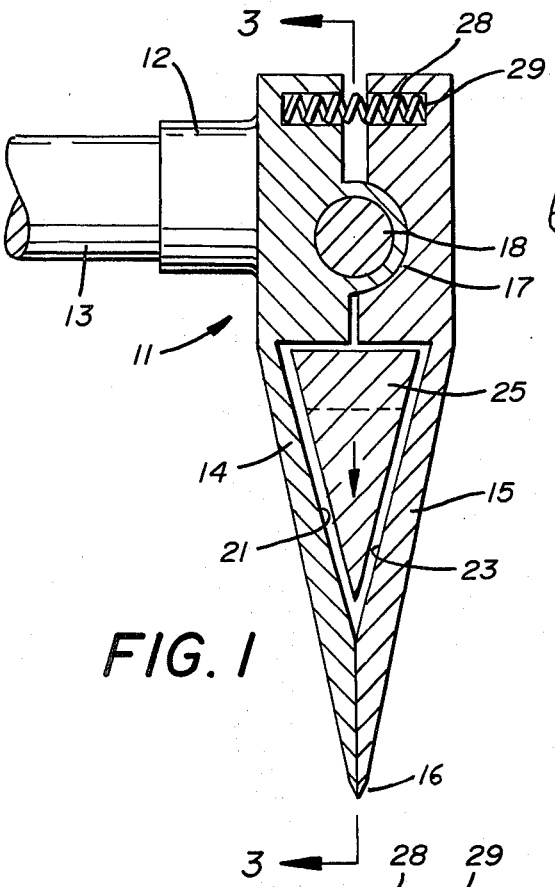
FIG. 1 is a sectional view of the splitting ax in closed position.
Figure 3:
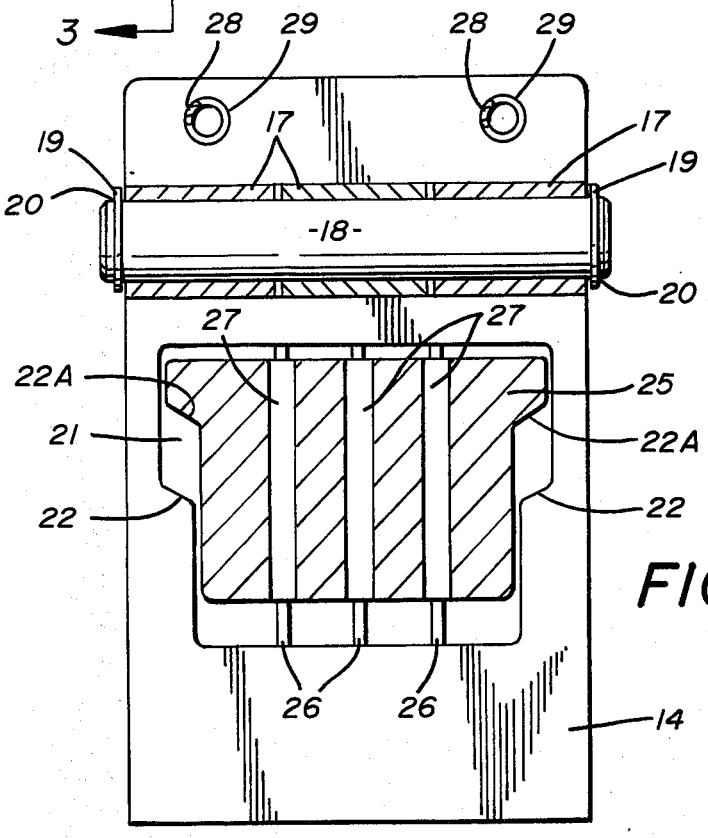
FIG. 3 is a section on line 3—3 of FIG. 1.

Referring to FIGS. 1 and 3 of the drawings, a splitting ax can be seen which comprises a two piece head portion 11. A socket 12 is formed on the head portion 11 and has a handle 13 extending therefrom. A pair of matching body members 14 and 15 make up the head portion 11 and each are of a generally rectangular configuration as best seen in FIG. 3 of the drawings. Each of the body members 14 and 15 is tapered inwardly along its lower half to form a cutting edge 16. The body members 14 and 15 are pivoted together by lugs 17 extending from each body member respectively. A heavy pin 18 passes through apertures in the lugs 17 pivotally securing the body members 14 and 15 together in a wedge configuration. Retainer rings 19 are positioned in ring receiving annular grooves 20 on either end of said pin 18 so as to retain the pin 18 in operational position. A recessed area 21 in the body member 14 is tapered inwardly towards the handle 13 and has oppositely disposed offset area defining a pair of shoulders 22. (See FIG. 3).

A similar recessed area 23 formed in the body member 15 together with a recessed area 21 defines a cavity 24 within the head portion 11. The cavity 24 receives a wedge 25 of a smaller matching exterior configuration to that of the interior of the cavity 24. The wedge 25 is movably disposed within said cavity 24 on raised guide surfaces 26 in the body members and corresponding grooves 27 on both sides of the wedge 25.

A pair of tensioned coil springs 28 are positioned in oppositely disposed openings 29 in the body members 14 and 15 opposite the cutting edges 16 so as to urge the cutting edges 16 toward one another.

Figure 2:
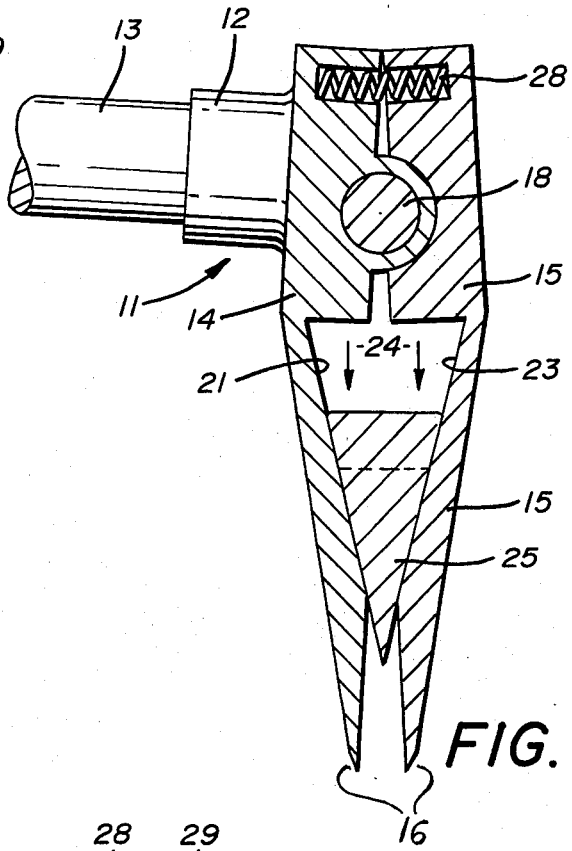
FIG. 2 is a sectional view of the splitting ax in open position.

Referring now to FIGS. 1 and 2 of the drawings, the splitting ax can be seen in operation wherein as the splitting ax is raised and rapidly moved downward towards the wood, the wedge 25 is held in the portion of the cavity 24 closest the pin 18. The head portion 11 is driven into the wood and stops, while at the same time the wedge 25 continues on within the cavity forcing the body members 14 and 15 to pivot apart. The wedge 25 is contained in the cavity 24 by the shoulders 22 engaging the corresponding configuration 22A on the wedge 25. The springs 28 having been compressed on impact now urge the cutting edges 16 of the body members 14 and 15 to pivot together again moving the wedge 25 back allowing the head portion 11 to be easily removed from the wood. The pivot action of the body members 14 and 15 upon impact in the wood tend to increase the splitting action of the ax in that the lateral forces produced by the movement of the wedge 25 expanding the body members 14 and 15 is proportional to the velocity with which the ax 10 strikes the wood and the kinetic energy generated by the rapid downward movement of the wedge 25.

It will thus be seen that a new and useful splitting ax has been illustrated and described, and it will apparent to those skilled in the art that various changes and modifications may be made herein without departing from the spirit of the invention.

I claim:

1. A splitting ax having a head portion consisting of a pair of oppositely disposed body members, each of which has an upper portion and an inwardly tapered lower portion terminating in a cutting edge, said upper portions being spaced with respect to one another and terminating in upper ends on a common plane, pivot means inwardly of said upper ends joining said upper portions, said lower portions defining a cavity, the opposite outer walls of which are tapered inwardly, said cavity spaced inwardly of said cutting edges, a wedge-shaped body freely positioned in said cavity, a handle and means on said head portion mounting said handle.

2. The splitting ax of claim 1 wherein tensioning means are engaged between opposed portions of said body members on the opposite side of said pivot means with respect to said cutting edge.

3. The splitting ax of claim 1 wherein, extensions are formed on said wedge-shaped body, and shoulders formed on said body members in said cavity engagable by said extensions on said wedge-shaped body to limit travel of said wedge-shaped body.

4. The splitting ax of claim 1 wherein, registering guide surfaces are formed on said wedge shaped body and on portions of said body members defining said cavity.

5. The splitting ax of claim 1 wherein said pivot means comprises apertured lugs on said body members, the apertures in said lugs forming an axial bore and a pivot pin disposed in said axial bore.

6. The splitting ax of claim 2 wherein said tensioning means comprise coil springs disposed in oppositely disposed openings in said body members.

* * * * *